US011688942B2

(12) United States Patent
Wang et al.

(10) Patent No.: US 11,688,942 B2
(45) Date of Patent: Jun. 27, 2023

(54) ANTENNA AND FABRICATING METHOD THEREOF, AND ANTENNA DEVICE AND FABRICATING METHOD THEREOF

(71) Applicants: Beijing BOE Sensor Technology Co., Ltd., Beijing (CN); BOE Technology Group Co., Ltd., Beijing (CN)

(72) Inventors: Ying Wang, Beijing (CN); Tienlun Ting, Beijing (CN); Jie Wu, Beijing (CN); Haocheng Jia, Beijing (CN); Liang Li, Beijing (CN); Cuiwei Tang, Beijing (CN); Qiangqiang Li, Beijing (CN); Wei Zhang, Beijing (CN); Meng Wei, Beijing (CN); Hao Liu, Beijing (CN); Chuncheng Che, Beijing (CN)

(73) Assignees: BEIJING BOE SENSOR TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 7 days.

(21) Appl. No.: 17/467,693

(22) Filed: Sep. 7, 2021

(65) Prior Publication Data

US 2022/0077579 A1 Mar. 10, 2022

(30) Foreign Application Priority Data

Sep. 8, 2020 (CN) ..... 202010934857.6

(51) Int. Cl.
*H01Q 13/06* (2006.01)
*H01Q 9/04* (2006.01)
(Continued)

(52) U.S. Cl.
CPC ..... *H01Q 3/36* (2013.01); *H01Q 9/0471* (2013.01); *H01Q 13/02* (2013.01); *H01Q 13/06* (2013.01)

(58) Field of Classification Search
CPC .... H01Q 3/36; H01Q 9/0471; H01Q 13/0283; H01Q 21/0087; H01Q 21/064;
(Continued)

(56) References Cited

U.S. PATENT DOCUMENTS 6,417,806 B1 * 7/2002 Gothard ..... H01Q 21/061 343/702
10,361,476 B2 * 7/2019 Ou ..... H01Q 13/02
(Continued)

*Primary Examiner* — Vibol Tan
(74) *Attorney, Agent, or Firm* — Nath, Goldberg & Meyer; Joshua B. Goldberg

(57) ABSTRACT

The present disclosure provides an antenna, an antenna device, a fabricating method of the antenna, and a fabricating method of the antenna device, and relates to the field of antenna technology. The antenna includes a first substrate; a base material layer on the first substrate and having a plurality of antenna cavities arranged in an array therein; and a conductive layer on an inner side of each of the plurality of antenna cavities, each of the plurality of antenna cavities and the conductive layer on the inner side thereof forming an antenna unit, wherein each of the plurality of antenna cavities includes a first opening, and an aperture of the first opening at a position of the antenna cavity close to the first substrate is smaller than an aperture of the first opening at a position of the antenna cavity away from the first substrate.

19 Claims, 8 Drawing Sheets

(51) Int. Cl.
*H01Q 3/36* (2006.01)
*H01Q 13/02* (2006.01)

(58) Field of Classification Search
CPC ..... H01Q 1/38; H01Q 1/50; H01Q 1/523; H01Q 13/18; H01Q 13/02; H01Q 13/10; H01Q 13/06
See application file for complete search history.

(56) References Cited

U.S. PATENT DOCUMENTS

| | | | | |
|---|---|---|---|---|
| 11,211,687 | B2 * | 12/2021 | Chen | H01L 21/4846 |
| 11,411,292 | B2 * | 8/2022 | Kirino | H05B 6/806 |
| 2019/0319663 | A1 * | 10/2019 | Shimura | H01Q 1/241 |
| 2020/0161735 | A1 * | 5/2020 | Kamo | H01P 5/08 |
| 2021/0194141 | A1 * | 6/2021 | McKinstry | G02F 1/0322 |

* cited by examiner

51

ANTENNA AND FABRICATING METHOD THEREOF, AND ANTENNA DEVICE AND FABRICATING METHOD THEREOF

CROSS-REFERENCE TO RELATED APPLICATION

This application claims the benefit of priority to Chinese Patent Application No. 202010934857.6 filed on Sep. 8, 2020, the contents of which are incorporated herein in their entirety by reference.

TECHNICAL FIELD

The present disclosure relates to the field of antenna technology, and particularly relates to an antenna, an antenna device, a fabricating method of the antenna, and a fabricating method of the antenna device.

BACKGROUND

In the related art, the antenna is generally a planar microstrip antenna, such as a patch antenna.

SUMMARY

In an aspect, the present disclosure provides an antenna, including: a first substrate; a base material layer on the first substrate and having a plurality of antenna cavities arranged in an array therein; and a conductive layer on a sidewall of each of the plurality of antenna cavities, each of the plurality of antenna cavities and the conductive layer on the sidewall thereof forming an antenna unit, wherein each of the plurality of antenna cavities includes a first opening, and an aperture of the first opening at a position of the antenna cavity close to the first substrate is smaller than an aperture of the first opening at a position of the antenna cavity away from the first substrate.

In an embodiment, each of the plurality of antenna cavities includes a first cavity and a second cavity in physical contact with the first cavity, the second cavity being closer to the first substrate than the first cavity; the first cavity includes a second opening, and the second cavity includes a third opening; in a direction pointing from the second cavity to the first cavity, an aperture of the second opening gradually increases, and an aperture of the third opening is constant; and a difference between the aperture of the second opening at a position of the first cavity in physical contact with the second cavity and the aperture of the third opening is smaller than a first value.

In an embodiment, the first value is 1 μm.

In an embodiment, the aperture of the second opening at the position of the first cavity in physical contact with the second cavity is equal to the aperture of the third opening.

In an embodiment, the first cavity includes at least one first sidewall inclined relative to the first substrate; and the second cavity includes at least one second sidewall perpendicular to the first substrate.

In an embodiment, the first cavity has a hollow portion of a truncated pyramid shape and includes four first sidewalls inclined relative to the first substrate; and the second cavity has a hollow portion of a cuboid shape and includes four second sidewalls perpendicular to the first substrate.

In an embodiment, the first cavity has a hollow portion of a circular truncated cone shape and includes an arc-shaped first sidewall inclined relative to the first substrate; and the second cavity has a hollow portion of a cylinder shape and includes an arc-shaped second sidewall perpendicular to the first substrate.

In an embodiment, a material of the base material layer includes any one of silicon, quartz, and ceramic.

The present disclosure further provides an antenna device, including the antenna described above and a phase shifter connected to the antenna.

In an embodiment, the phase shifter includes second and third substrates opposite to each other, and a dielectric layer between the second and third substrates, and the second and third substrates are configured to generate an electric field therebetween to change a dielectric constant of the dielectric layer.

In an embodiment, the first substrate serves as the second substrate.

In an embodiment, a first electrode layer is on a side of the second substrate close to the third substrate, and a second electrode layer is on a side of the third substrate close to the second substrate;

the first electrode layer has a plurality of slits, the plurality of slits are in one-to-one correspondence with the plurality of antenna cavities, and an orthographic projection of the first opening of each of the plurality of antenna cavities on the third substrate at least partially overlaps with an orthographic projection of the slit corresponding to the first opening on the third substrate; and the second electrode layer includes a plurality of sub-electrodes, the plurality of sub-electrodes are in one-to-one correspondence with the plurality of antenna cavities, and the orthographic projection of the first opening of each of the plurality of antenna cavities on the third substrate at least partially overlaps with an orthographic projection of the sub-electrode corresponding to the first opening on the third substrate.

In an embodiment, each of the plurality of sub-electrodes has a shape of at least one of a comb shape and a spiral shape when viewed in a plan view.

The present disclosure further provides a method for fabricating an antenna, including: preparing a first substrate; forming a base material layer on the first substrate; forming a plurality of antenna cavities arranged in an array in the base material layer; and forming a conductive layer on a sidewall of each of the plurality of antenna cavities, wherein each of the plurality of antenna cavities includes a first opening, and an aperture of the first opening at a position of the antenna cavity close to the first substrate is smaller than an aperture of the first opening at a position of the antenna cavity away from the first substrate.

In an embodiment, a material of the base material layer is silicon; and forming the plurality of antenna cavities arranged in an array in the base material layer includes: forming the plurality of antenna cavities arranged in an array by a bulk silicon etching process.

The present disclosure further provides a method for fabricating an antenna device, including: fabricating an antenna, wherein the antenna is the antenna according to embodiments of the present disclosure; fabricating a phase shifter; and assembling the antenna and the phase shifter into a single body by a bonding process or a laminating process.

DETAILED DESCRIPTION

Figure 1:
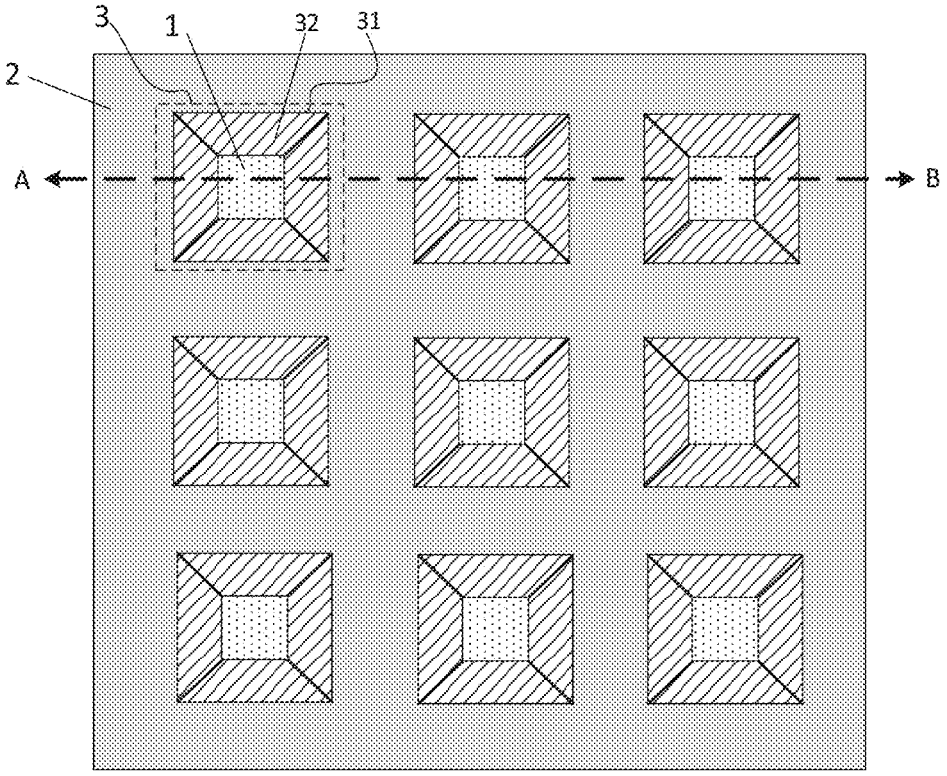
FIG. 1 is a top view of an antenna according to an embodiment of the present disclosure.

In order to make those skilled in the art better understand the technical solutions of the present disclosure, the present disclosure is further described in detail below with reference to the accompanying drawings and the specific embodiments.

The shapes and sizes of the components in the drawings are drawn not to scale, but are merely intended to facilitate an understanding of the contents of the embodiments of the present disclosure.

Unless defined otherwise, technical or scientific terms used in the present disclosure shall have the ordinary meaning as understood by one of ordinary skill in the art to which the present disclosure belongs. The terms "first", "second", and the like as used in the present disclosure are not intended to indicate any order, quantity, or importance, but rather to distinguish one element from another. Similarly, the term "a", "an", "the" or the like do not denote a limitation of quantity, but rather denote the presence of at least one. The term "include", "comprise", or the like, means that the element or item preceding the term includes the element or item listed after the term and its equivalent, but does not exclude other elements or items. The term "connected", "coupled" or the like is not restricted to physical or mechanical connections, but may include electrical connections, whether direct or indirect. The terms "upper", "lower", "left", "right", and the like are used only to indicate relative positional relationships, and when the absolute position of the object being described is changed, the relative positional relationships may also be changed accordingly.

The patch antenna includes a dielectric substrate, a metal layer on the dielectric substrate, and a reference electrode layer below the dielectric substrate. However, since the patch antenna has a narrow gain bandwidth, application of the patch antenna to an antenna device results in a low gain and a low power capacity of the antenna device.

Figure 2:
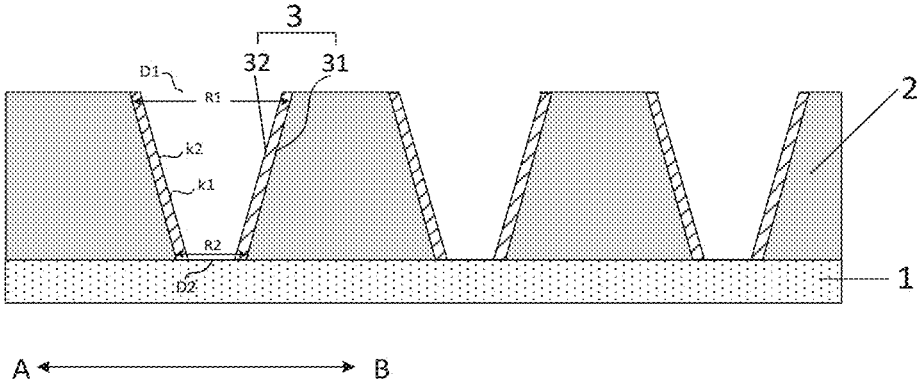
FIG. 2 is a cross-sectional view, taken along line A-B of FIG. 1, of an antenna according to an embodiment of the present disclosure.

In a first aspect, as shown in FIG. 1 and FIG. 2, the embodiment provides an antenna, FIG. 1 is a top view of the antenna, and FIG. 2 is a cross-sectional view taken along line A-B in FIG. 1. The antenna includes a first substrate 1, a base material layer 2 and a plurality of antenna units 3.

In an embodiment, the base material layer 2 is on the first substrate 1, the base material layer 2 has a plurality of antenna cavities 31 arranged in an array, a sidewall of each antenna cavity 31 is provided with a conductive layer 32, and each antenna cavity 31 and the conductive layer 32 on the sidewall of the antenna cavity 31 form an antenna unit 3. In an embodiment, the conductive layer 32 has a uniform thickness. In an embodiment, the number of the antenna units 3 included in the antenna is not limited, and the antenna may include any number of rows or columns of antenna units 3, and the following description is given by taking the case that the antenna includes antenna units 3 in a 3×3 array as an example. The antenna unit 3 is a radiating unit and is configured to transmit radio frequency (RF) signals. In an embodiment, each antenna cavity 31 includes a proximal opening D2 on a side of the antenna cavity 31 close to the first substrate 1, and a distal opening D1 on a side of the antenna cavity 31 away from the first substrate 1. In FIG. 2, the proximal opening D2 is an opening at a lower part of the antenna cavity 31, the distal opening D1 is an opening at an upper part of the antenna cavity 31, and an aperture R1 of the distal opening D1 is larger than an aperture R2 of the proximal opening D2. In the antenna cavity 31, the aperture relatively away from the first substrate 1 is not smaller than the aperture relatively close to the first substrate 1. For example, as shown in FIG. 2, the position shown by K2 of the antenna cavity 31 in FIG. 2 is farther from the first substrate 1 than the position shown by K1, and the aperture of the antenna cavity 31 at the position shown by K2 is not smaller than the aperture of the antenna cavity 31 at the position shown by K1. In an embodiment, the apertures of the antenna cavity 31 at various positions are determined according to the structure of the antenna cavity 31. By taking a case that the antenna cavity 31 in FIG. 2 has a shape of truncated cone as an example, the aperture of the antenna cavity 31 gradually increases in a direction from the first substrate 1 towards the distal opening D1, and thus the aperture of the antenna cavity 31 at the position relatively away from the first substrate 1 is greater than the aperture of the antenna cavity 31 at the position relatively close to the first substrate 1. Thus, the antenna cavity 31 is formed as a horn shape having a small aperture at a lower part and a large aperture at an upper part. The conductive layer 32 covers the sidewall of the antenna cavity 31 along the shape of the antenna cavity 31, and thus the conductive layer 32 also has a horn shape. In other words, the conductive layer 32 is conformally formed on the sidewall of the antenna cavity 31. Therefore, in a case where the antenna unit 3 (the antenna cavity 31 and the conductive layer 32) shown in the embodiment is applied to an antenna device, the horn-shaped conductive layer 32 can greatly improve the efficiency and power capacity of the antenna device, and can realize the function of electronic control beam scanning having a high gain.

It should be noted that, the base material layer 2 is a material layer defining the sidewall of the antenna cavity 31, the base material layer 2 is etched to form the plurality of antenna cavities 31 in the base material layer 2, and the depth of the base material layer 2 is equal to the depths of the antenna cavities 31. The depth of the conductive layer 32 on the sidewall of the antenna cavity 31 in the direction perpendicular to the first substrate 1 may be equal to the depth of the antenna cavity 31, or may be smaller than the depth of the antenna cavity 31, which is not limited herein.

Figure 3:
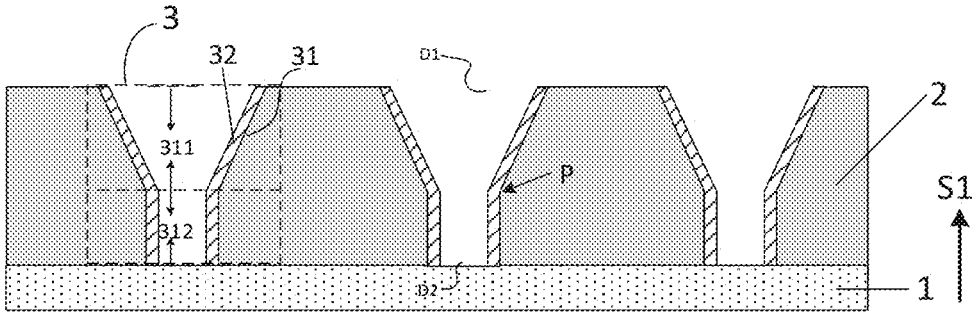
FIG. 3 is a cross-sectional view of an antenna according to another embodiment of the present disclosure.

In the antenna according to the embodiment, the shape of the antenna cavity 31 may be in various forms. For example, as shown in FIG. 3, the antenna cavity 31 of each antenna unit 3 may include a plurality of portions. For example, the antenna cavity 31 includes a first cavity 311 and a second cavity 312, and the second cavity 312 is closer to the first substrate 1 than the first cavity 311. In an embodiment, the aperture of the first cavity 311 gradually increases in a direction (a direction indicated by an arrow S1 in FIG. 3) pointing from the second cavity 312 to the first cavity 311. In addition, in the direction (the direction indicated by the arrow S1 in FIG. 3) pointing from the second cavity 312 to the first cavity 311, the aperture of the second cavity 312 is constant. The end of the first cavity 311 close to the second cavity 312 is tightly connected with the end of the second cavity 312 close to the first cavity 311. As shown in FIG. 3, the lower end indicated by "P" of the first cavity 311 is tightly connected to the upper end indicated by "P" of the second cavity 312, and the difference between the aperture of the first cavity 311 at the end of the first cavity 311 close to the second cavity 312 and the aperture of the second cavity 312 at the end of the second cavity 312 close to the first cavity 311 is smaller than a first preset value, which may be any value, for example, 1 μm. The smaller the first preset value is, the smaller the difference between the aperture of the first cavity 311 at its lower portion and the aperture of the second cavity 312 at its upper portion is, and the stronger the sealing property at the interface therebetween is. In an embodiment, the aperture of the first cavity 311 at its end close to the second cavity 312 may be equal to the aperture of the second cavity 312 at its end close to the first cavity 311.

Figure 4:
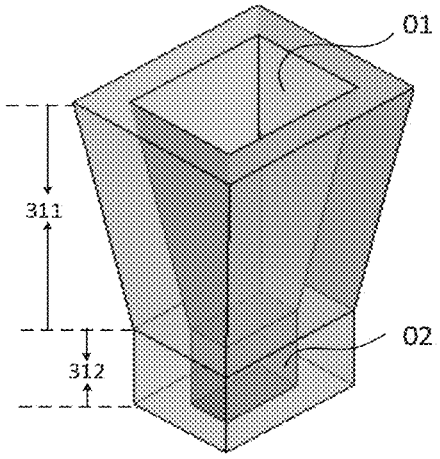
FIG. 4 is a perspective view of a conductive layer of an antenna unit according to an embodiment of the present disclosure.
Figure 5:
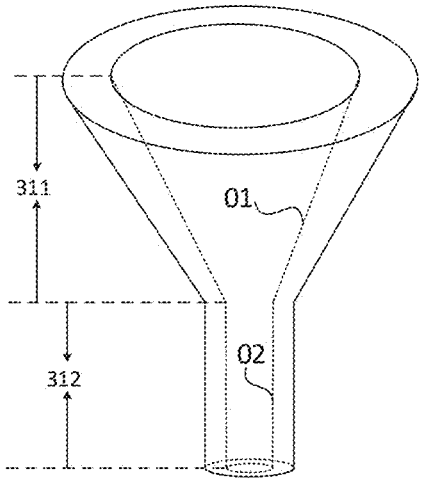
FIG. 5 is a perspective view of a conductive layer of an antenna unit according to another embodiment of the present disclosure.

In an embodiment, the shape of the antenna cavity 31 may include various types. For example, the antenna cavity 31 may be a horn-shaped cavity having a truncated pyramid shape, a circular truncated cone shape, or the like. For example, the description is given by taking the case that the antenna cavity 31 includes the first cavity 311 and the second cavity 312 as an example. As shown in FIGS. 4 and 5, the first cavity 311 may include at least one first sidewall 01, a cavity enclosed (i.e., defined) by the first sidewall 01 is the first cavity 311, the base material layer 2 is a material of the first sidewall 01, and the first sidewall 01 is inclined relative to the first substrate 1, so that the aperture of the first cavity 311 formed by the first sidewall 01 gradually increases in the direction from bottom (close to the first substrate 1) to top (away from the first substrate 1), thereby forming a horn-shaped radiation surface. The second cavity 312 may include at least one second sidewall 02, a cavity enclosed (i.e., defined) by the second sidewall 02 is the second cavity 312, the base material layer 2 is a material of the second sidewall 02, and the second sidewall 02 is perpendicular to the first substrate 1, so that the aperture of the second cavity 312 formed by the second sidewall 02 in the direction from bottom (close to the first substrate 1) to top (away from the first substrate 1) is constant, thereby forming an input channel of the RF signal. The first sidewall 01 extends to an upper portion of the second sidewall 02 and is connected to (i.e., in physical contact with) the second sidewall 02, so as to define the antenna cavity 31.

In some embodiments, as shown in FIGS. 1, 3, and 4, based on the above embodiments, the first cavity 311 may have the truncated pyramid shape, and the first cavity 311 includes four first sidewalls 01 inclined relative to the first substrate 1, and the four first sidewalls 01 are connected to form the first cavity 311. In other words, the first cavity 311 has a hollow portion of a truncated pyramid shape. In an embodiment, the second cavity 312 has a cuboid shape, the second cavity 312 includes four second sidewalls 02 perpendicular to the first substrate 1, and the four second sidewalls 02 are connected to form the second cavity 312. In other words, the second cavity 312 has a hollow portion of a cuboid shape. The four first sidewalls 01 extend to the upper portions of the second sidewalls 02 to be connected to the four second sidewalls 02, respectively. The RF signal enters into the second cavity 312 from the lower portions of the second sidewalls 02, passes through the first cavity 311, and is sent out of the antenna.

In some embodiments, as shown in FIG. 5, the first cavity 311 may be a circular truncated cone shape, and the first cavity 311 includes an arc-shaped first sidewall 01 inclined relative to the first substrate 1, and the arc-shaped first sidewall 01 defines the first cavity 311. In other words, the first cavity 311 has a hollow portion of a circular truncated cone shape. The second cavity 312 has a cylinder shape, and the second cavity 312 includes an arc-shaped second sidewall 02 perpendicular to the first substrate 1, and the arc-shaped second sidewall 02 defines the second cavity 312. In other words, the second cavity 312 has a hollow portion of a cylinder shape. In an embodiment, the first sidewall 01 extends to an upper portion of the second sidewall 02 to be connected to (i.e., in physical contact with) the second sidewall 02. The RF signal enters into the second cavity 312 from the lower portion of the second cavity 312, passes through the first cavity 311, and is sent out of the antenna.

In an embodiment, the antenna cavity 31 may have other shapes, and the specific structure thereof may be designed as needed, as long as the aperture R1 of the distal opening D1 of the antenna cavity 31 is larger than the aperture R2 of the proximal opening D2 of the antenna cavity 31, and the aperture of the antenna cavity 31 at a position relatively away from the first substrate 1 is not smaller than the aperture of the antenna cavity 31 at a position relatively close to the first substrate 1 in the whole structure of the antenna cavity 31.

It should be noted that the sidewall of the antenna cavity 31 is provided with the conductive layer 32, the conductive layer 32 uniformly covers the sidewall along the shape of the sidewall of the antenna cavity 31, and the shape of the conductive layer 32 is defined by the antenna cavity 31, so the shape of the antenna cavity 31 is the same as the shape of the film structure of the conductive layer 32 as formed.

In an embodiment, the base material layer 2 may include various types of materials. For example, the material of the base material layer 2 may include silicon, quartz, ceramic, etc., and thus the antenna cavity 31 may be fabricated by a semiconductor processing, such as a micro-fabrication process or a process for fabricating a MEMS (Micro-Electro-Mechanical System), etc.

In an embodiment, the base material layer 2 may be a monolithic substrate, and the first cavity 311 and the second cavity 312 may be formed as a single structure and are formed in the base material layer 2 in the same etching process. The base material layer 2 may also include a plurality of sub-substrates, for example, a first sub-substrate and a second sub-substrate, which are stacked. In an embodiment, the first cavity 311 is formed in the first sub-substrate, the second cavity 312 is formed in the second sub-substrate, the etched first and second sub-substrates are stacked and bonded to form the base material layer 2, and the first cavity 311 and the second cavity 312 are aligned and assembled to form the antenna cavity 31. The specific configuration may be set according to actual needs, and is not limited herein.

Figure 6:
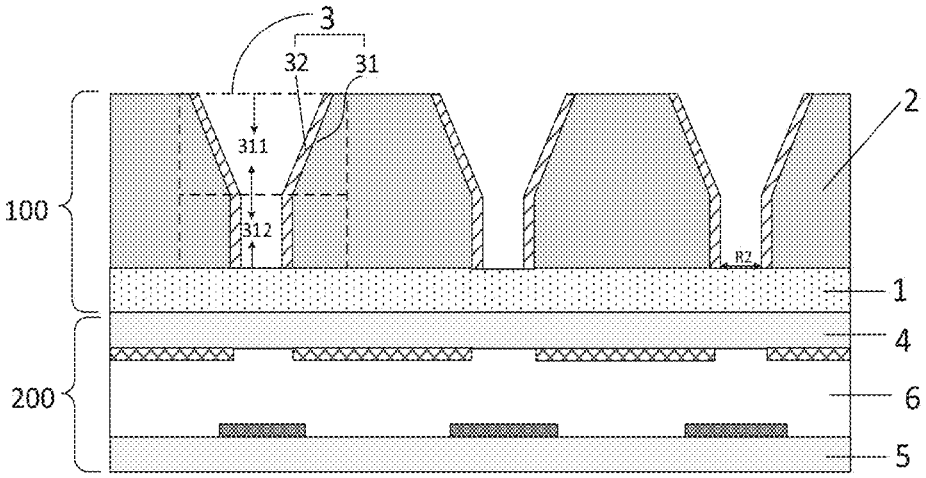
FIG. 6 is a schematic diagram of a layer structure of an antenna device according to an embodiment of the present disclosure.

In a second aspect, as shown in FIG. 6, the embodiment further provides an antenna device including a phase shifter 200 and an antenna 100 according to an embodiment of the present disclosure, the phase shifter 200 is in physical contact with the antenna 100 and is disposed on a side of the antenna 100 on which the first substrate is disposed. The phase shifter 200 can change the phase of the beam to be transmitted by the antenna device, and adjust the transmission angle of the beam. The phase shifter 200 may be various types of phase shifters, such as a microstrip phase shifter, an out-of-plane coupling phase shifter, a semiconductor phase shifter, a coplanar waveguide (CPW) phase shifter, an adjustable dielectric phase shifter, and the like, which are not limited herein. In the following, the description will be given by taking the case that the phase shifter 200 is an adjustable dielectric phase shifter (specifically, a liquid crystal phase shifter) as an example.

In an embodiment, as shown in FIG. 6, by taking the case that the phase shifter 200 is an adjustable dielectric phase shifter as an example, the phase shifter 200 includes a second substrate 4 and a third substrate 5 opposite to each other, and a dielectric layer 6 between the second substrate 4 and the third substrate 5. The dielectric layer 6 has an adjustable dielectric therein, and an electric field between the second substrate 4 and the third substrate 5 may be changed by voltages applied to the second substrate 4 and the third substrate 5. The dielectric constant of the dielectric layer 6 may be changed by changing the electric field between the second substrate 4 and the third substrate 5, so that the phase of the RF signal (i.e., the beam) can be changed after the RF signal passes through the dielectric layer 6, and then the RF signal enters into the antenna 100 to be transmitted by the antenna 100. The adjustable dielectric in the dielectric layer 6 may include various types, for example the dielectric layer 6 includes a plurality of liquid crystal molecules.

Figure 7:
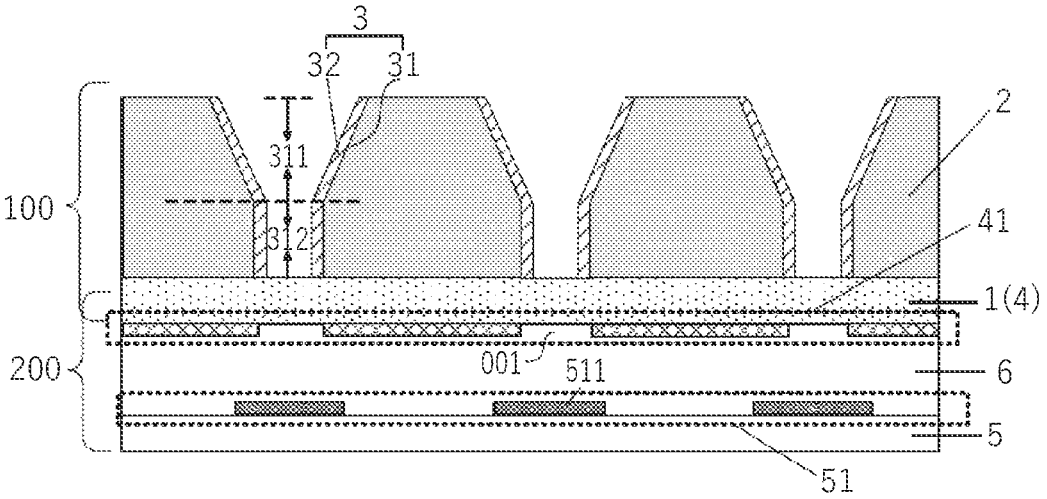
FIG. 7 is a schematic diagram of a layer structure of an antenna device according to another embodiment of the present disclosure.

In an embodiment, as shown in FIG. 7, the antenna 100 is disposed on a side of the second substrate 4 of the phase shifter 200 away from the third substrate 5, and the second substrate 4 of the phase shifter 200 may be reused as the first substrate 1 of the antenna 100, so that the thickness of the antenna device can be reduced.

In an embodiment, as shown in FIGS. 6 and 7, a side of the second substrate 4 of the phase shifter 200 close to the third substrate 5 is provided with a first electrode layer 41, and a side of the third substrate 5 close to the second substrate 4 is provided with a second electrode layer 51. An external power supply applies a first voltage to the first electrode layer 41 and applies a second voltage to the second electrode layer 51, so that an electric field is formed between the first electrode layer 41 and the second electrode layer 51, the dielectric constant of the dielectric layer 6 can be changed to realize a phase shift function, and the RF signal of which a phase has been shifted is fed into the antenna unit 3 corresponding to the antenna cavity 31 from the proximal opening D2 of the antenna cavity 31.

Figure 8:
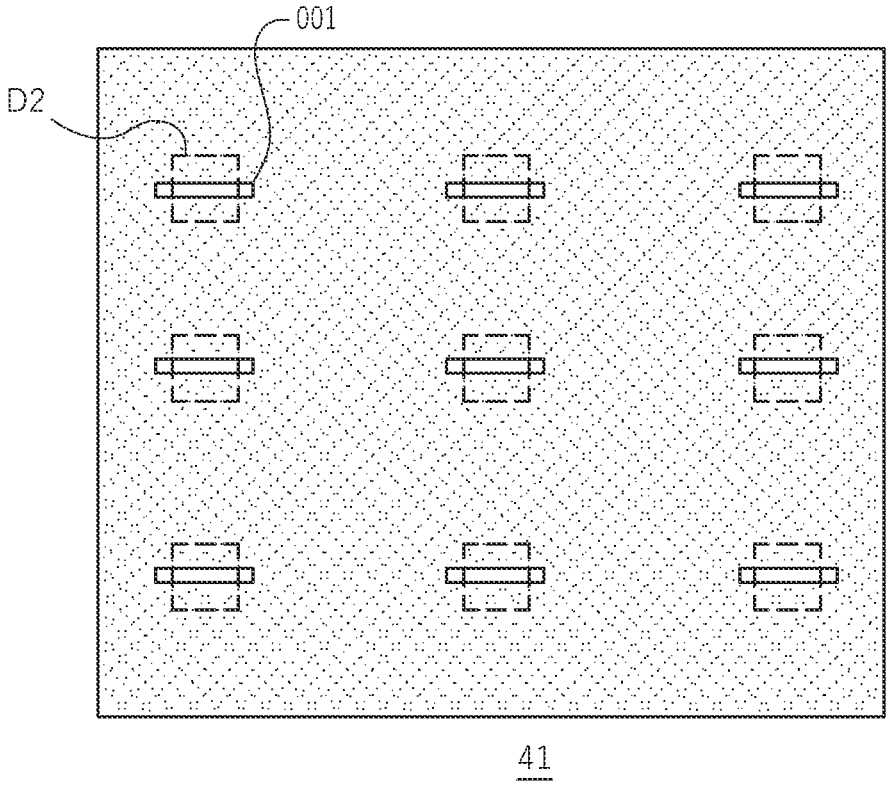
FIG. 8 is a top view of a first electrode layer of an antenna device according to an embodiment of the present disclosure.
Figure 9:
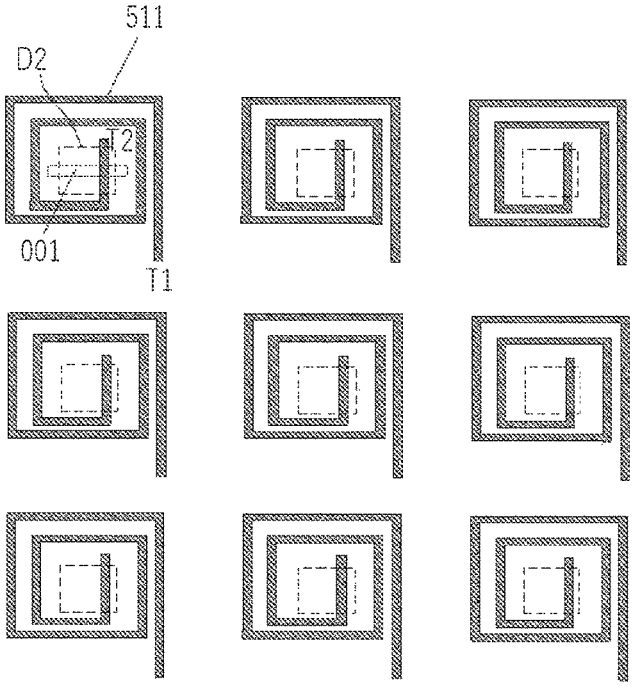
FIG. 9 is a top view of a second electrode layer of an antenna device according to an embodiment of the present disclosure.

In an embodiment, the structures of the first electrode layer 41 and the second electrode layer 51 may include various types. For example, as shown in FIGS. 7 to 9, FIG. 8 is a top view of the first electrode layer 41, and FIG. 9 is a top view of the second electrode layer 51. In the embodiments shown in FIGS. 8 and 9, the base material layer 2 includes antenna units 3 in a 3×3 array. In order to illustrate the positional relationship between the antenna cavity 31 and the first and second electrode layers 41 and 51, an orthogonal projection of the proximal opening D2 of the antenna cavity 31 on the first or second electrode layer 41 or 51 is indicated by a rectangular dashed box in the figures. Referring to FIG. 8, the first electrode layer 41 has a plurality of slits 001, each slit 001 corresponds to one antenna cavity 31, that is, the slits 001 are in one-to-one correspondence with the antenna cavities 31, the orthographic projection of the proximal opening D2 of each antenna cavity 31 on the third substrate 5 overlaps with an orthographic projection of the slit 001 corresponding to the antenna cavity 31 on the third substrate 5. That is, the first electrode layer 41 has slits at positions corresponding to the proximal openings D2 (i.e., the input ports of the RF signal) of the antenna cavities 31, so that the RF signal can be fed into the antenna cavities 31 through the slits 001. The slit 001 may be disposed at any position of the first electrode layer 41 corresponding to the proximal opening D2 of the antenna cavity 31. The size of the slit 001 may be set as required, and the size of the slit 001 may be larger than the proximal opening D2 or may be smaller than the proximal opening D2, as long as there is an overlapping region between the orthographic projection of the slit 001 and the orthographic projection of the proximal opening D2 on the third substrate 5.

In an embodiment, as shown in FIG. 9, the second electrode layer 51 includes a plurality of sub-electrodes 511 arranged at intervals, each sub-electrode 511 corresponds to one antenna cavity 31, that is, the antenna cavities 31 are in one-to-one correspondence with the sub-electrodes 511, and each sub-electrode 511 feeds a signal to the antenna unit 3 to which the corresponding antenna cavity 31 belongs. The shape of the sub-electrode 511 may be of various types, such as comb shape or spiral shape, when viewed in a plan view. The description will be given by taking a case that the sub-electrode 511 is a spiral electrode shown in FIG. 9 as an example. The orthographic projection of the proximal opening D2 of each antenna cavity 31 on the third substrate 5 overlaps with the orthographic projection of the sub-electrode 511 corresponding to the antenna cavity 31 on the third substrate 5, so that the sub-electrode 511 can feed power to the conductive layer 32 on the sidewall of the antenna cavity 31. In addition, the slits 001 in the first electrode layer 41 are also in one-to-one correspondence with the sub-electrodes 511, and the orthographic projection of the slit 001 on the third substrate 5 overlaps with the orthographic projection of a feeding end of the sub-electrode 511 corresponding to the slit 001 on the third substrate 5, so that the electric signal at the feeding end of the sub-electrode 511 can be fed into the corresponding antenna cavity 31 from the slit 001 through the proximal opening D2 after being subjected to phase shift by the dielectric layer 6. As shown in FIG. 9, by taking the case that the sub-electrode 5 is a spiral electrode as an example, one end of the spiral electrode is a receiving end T1, and the other end of the spiral electrode is the feeding end T2. After being received by the receiving end T1, the signal is fed into the antenna cavity 31 through the feeding end T2.

In an embodiment, the first substrate 1, the second substrate 4, and the third substrate 5 may include various types of substrates. For example, the first substrate 1 or the second substrate 4 may be a glass substrate, the third substrate 5 may be a glass substrate, or may also be various types of flexible substrates, for example, a polyimide substrate. In the case where the third substrate 5 of the phase shifter 200 is a flexible substrate, the conformal antenna device may be easily achieved, and is suitable for application scenarios where the requirement for conformal property is high, such as satellite communication, which is not limited herein.

Figure 10:
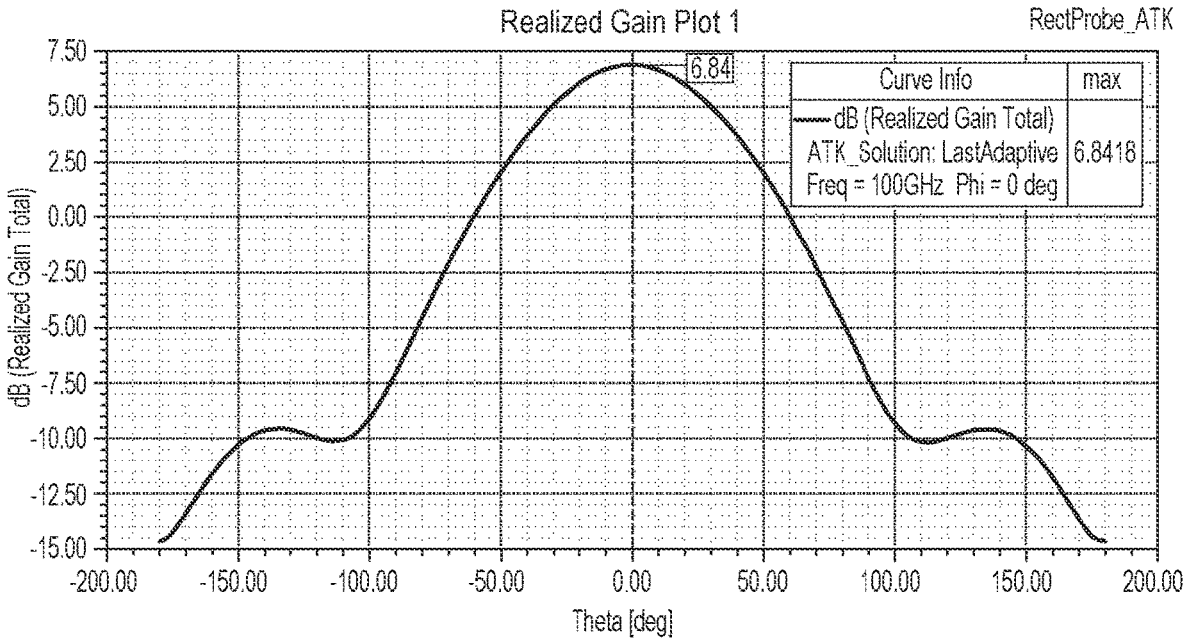
FIG. 10 is a diagram for simulating a gain of a microstrip patch antenna in the related art.
Figure 11:
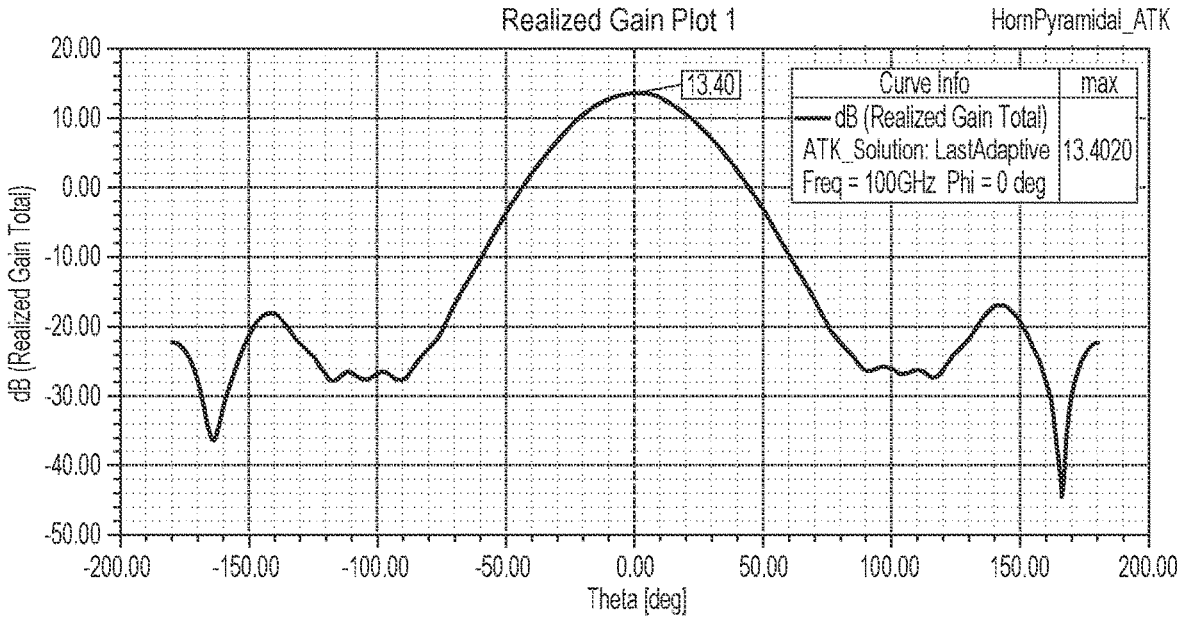
FIG. 11 is a diagram for simulating a gain of an antenna according to an embodiment of the present disclosure.
Figure 12:
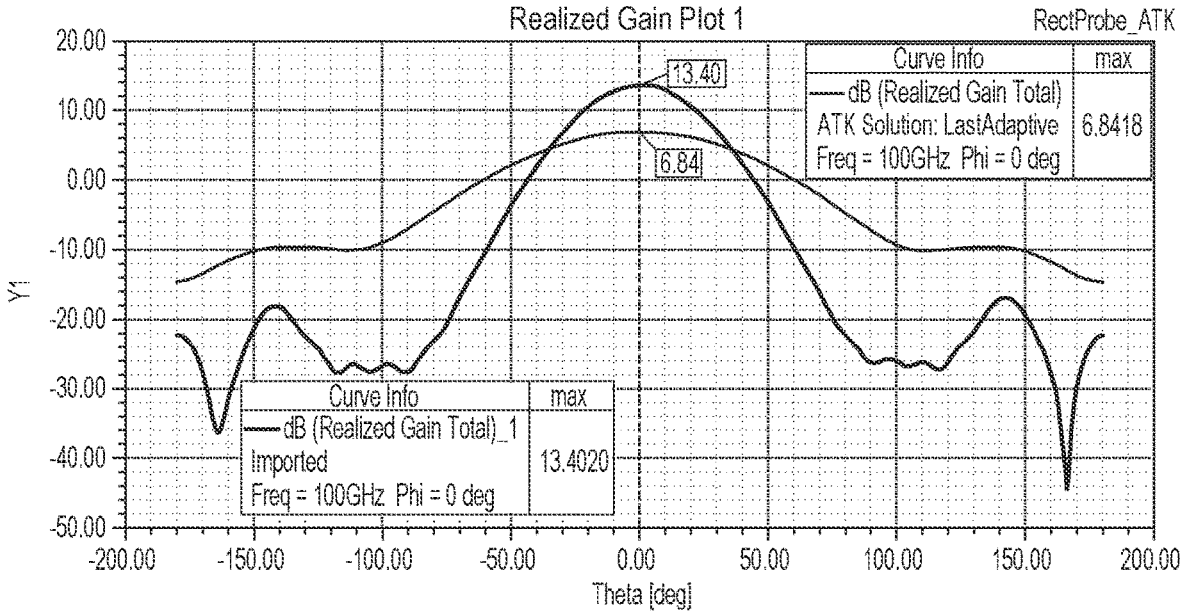
FIG. 12 is a diagram for comparing the gain of the antenna according to an embodiment of the present disclosure with the gain of the microstrip patch antenna in the related art.

Referring to FIGS. 10 to 12, FIG. 10 is a diagram for simulating a gain of a microstrip patch antenna in the related art, FIG. 11 is a diagram for simulating a gain of an antenna according to an embodiment of the present disclosure, and FIG. 12 is a diagram for comparing the gain of the antenna according to an embodiment of the present disclosure with the gain of the microstrip patch antenna in FIG. 10. In FIGS. 10 to 12, the abscissa denotes the transmission angle of the beam transmitted by the antenna, and the ordinate denotes the gain of the antenna. It is obvious from the simulation result that the maximum gain of the antenna in the embodiment is 13.4 dB, while the maximum gain of the microstrip patch antenna in FIG. 11 is 6.84 dB, and thus when the antenna of the embodiment is applied to an antenna device, the gain of the antenna can be significantly increased.

Figure 13:
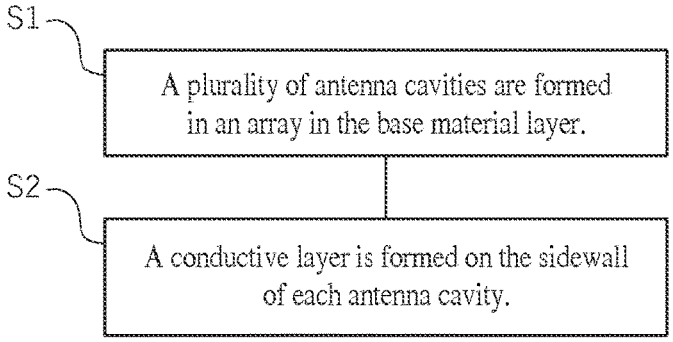
FIG. 13 is a flowchart of a method for fabricating an antenna according to the present disclosure.

In a third aspect, as shown in FIG. 13, the embodiment further provides a method for fabricating an antenna. As shown in (a) of FIG. 15, the method for fabricating an antenna includes steps S1 and S2, after the first substrate 1 is prepared and the base material layer 2 is disposed on the first substrate 1.

Figure 15:
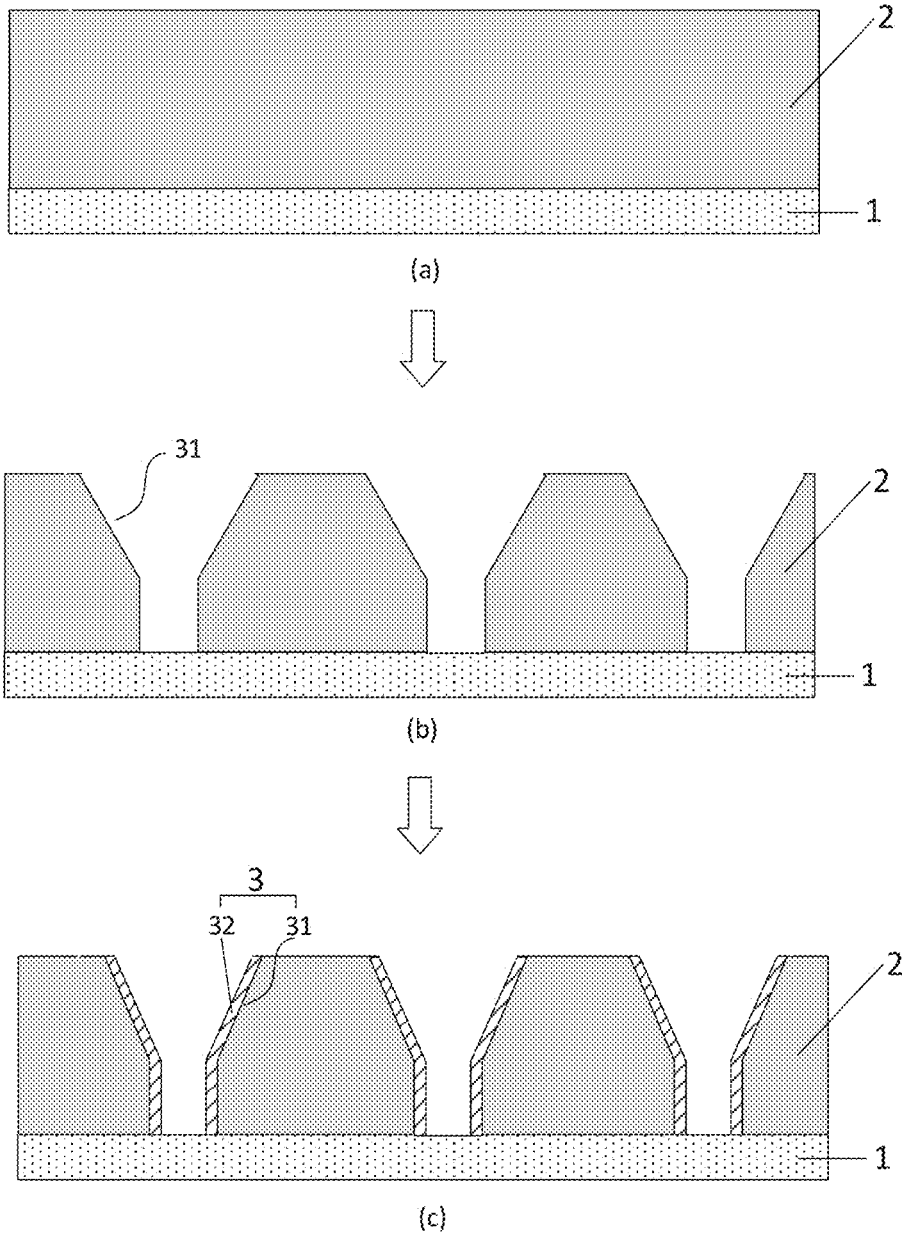
FIG. 15 is a diagram of various stages in a method for fabricating an antenna according to the present disclosure.

In step S1, as shown in (a) and (b) of FIG. 15, a plurality of antenna cavities 31 are formed in an array in the base material layer 2. In an embodiment, each antenna cavity 31 includes a proximal opening D2 close to the first substrate 1, and a distal opening D1 away from the first substrate 1, an aperture of the distal opening D1 is larger than an aperture of the proximal opening D2, and the aperture of the antenna cavity 31 relatively away from the first substrate 1 is not smaller than the aperture of the antenna cavity 31 relatively close to the first substrate 1.

In an embodiment, the base material layer 2 may be a monolithic substrate, and the antenna cavity 31 is formed in the base material layer 2 by a single etching process. The base material layer 2 may also include a plurality of stacked sub-substrates, each corresponding to a portion of the antenna cavity 31. The sub-substrates are etched respectively to form the portions of the antenna cavity 31 corresponding to the respective sub-substrates, and then the sub-substrates are stacked by a bonding process to form the base material layer 2, where the portions of the antenna cavity 31 in the sub-substrates are aligned to form the antenna cavity 31. The specific configuration may be set according to actual needs, and is not limited herein.

In an embodiment, the material of the base material layer 2 includes silicon, ceramics, quartz, and the like, and the description will be given by taking the case that the base material layer 2 includes silicon as an example. Step S1 may include: etching the base material layer 2 by using a bulk silicon etching process to form a plurality of antenna cavities 31 arranged in an array. In an embodiment, a wet etching process may be adopted, or a dry etching process may also be adopted to perform three-dimensional bulk silicon etching on the monocrystalline silicon substrate (i.e., the base material layer 2). In an embodiment, an anisotropic etching process may be adopted, and an isotropic etching process may also be adopted. By taking the anisotropic etching process as an example, the required shape of the antenna cavity 31 can be etched by providing a mask made of a corrosion-resistant material to control the etching speed by utilizing the characteristic that the etchant has different etching rates for different crystal orientations of the monocrystalline silicon substrate. Because the base material layer 2 is the silicon substrate, the bulk silicon process in the MEMS process may be used to form the antenna cavity 31, which can promote the etching accuracy of the antenna cavity 21.

In step S2, as shown in (b) and (c) of FIG. 15, a conductive layer 32 is formed on the sidewall of each antenna cavity 31.

In an embodiment, the material of the conductive layer 32 is sputtered or plated on the sidewall of the antenna cavity 31 by a sputtering process or a film plating process using a metal growth, and the material of the conductive layer 32 may be various conductive materials, such as copper, silver, aluminum, and the like.

Figure 14:
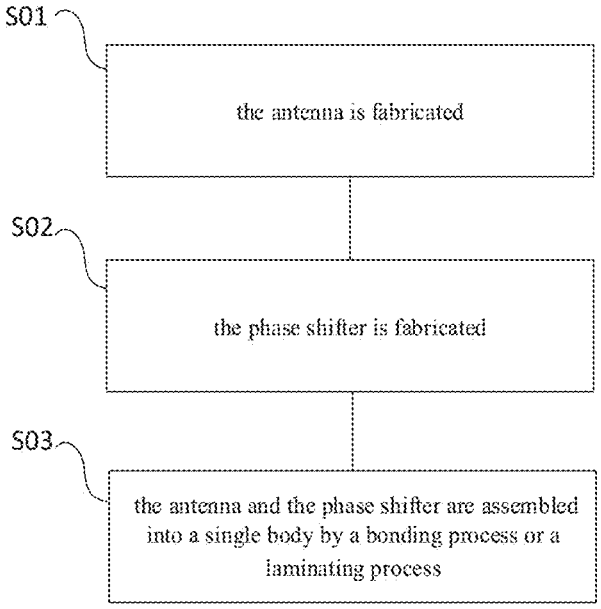
FIG. 14 is a flowchart of a method for fabricating an antenna device according to the present disclosure.

In a fourth aspect, as shown in FIG. 14, the embodiment further provides a method for fabricating an antenna device, including steps S01 to S04.

In step S01, the antenna 100 is fabricated.

Referring to FIG. 15, the description will be given by taking the case that the base material layer 2 of the antenna 100 is made of silicon, and the first substrate 1 is made of a glass substrate in the method for fabricating the antenna as an example.

In step S02, the phase shifter 200 is fabricated.

The lower substrate (i.e., the third substrate 5) of the phase shifter 200 may be a single substrate, or may be formed by stacking a plurality of substrates by a bonding process. The third substrate 5 may be a glass substrate, a quartz substrate, a polyimide substrate, or the like. The material of the second electrode layer 51 is applied on a side of the third substrate 5 opposite to the second substrate 4 by a sputtering or film plating process, and the material of the second electrode layer 51 includes various types of conductive materials, such as copper, silver, aluminum, and the like. In the case where the second electrode layer 51 includes a plurality of sub-electrodes 511, the entire layer of the second electrode layer 51 may be etched into the plurality of sub-electrodes 511 by an etching process. Similarly, the material of the first electrode layer 41 is applied on the side of the second substrate 4 opposite to the third substrate 5 by a sputtering or film plating process, and the material of the first electrode layer 41 includes various types of conductive materials, such as copper, silver, aluminum, and the like. In the case where the first electrode layer 41 has a plurality of slits 001, the plurality of slits 001 may be formed by etching the first electrode layer 41 by an etching process. Next, the second substrate 4 and the third substrate 5 are aligned and assembled together, and liquid crystal molecules are filled between the second substrate 4 and the third substrate 5 to form a dielectric layer 6 therebetween.

In step S03, the antenna 100 and the phase shifter 200 are assembled into a single body by a bonding process or a laminating process.

After the antenna 100 and the phase shifter 200 are fabricated, since the antenna 100 is a silicon-based semiconductor structure and the substrate of the phase shifter 200 is a glass structure, the antenna 100 and the phase shifter 200 can be stably connected through a bonding process or a laminating process, so as to form a complete antenna device. Compared with the related art where the antenna is a metal antenna such as a patch antenna, the antenna and the phase shifter can only be aligned and assembled by a mechanical assembly process, in the embodiment, the antenna 100 and the phase shifter 200 are aligned and assembled by a bonding process or a laminating process. The alignment precision of the bonding process or the laminating process is extremely high, the bonding quality is excellent, and the alignment tolerance can be effectively reduced.

In a fifth aspect, the embodiment further provides a display device, including the antenna device. It should be noted that the display device provided in the embodiment may be any product or component with a display function, such as a mobile phone, a tablet computer, a television, a display, a notebook computer, a digital photo frame, a navigator and the like. It should be understood by those skilled in the art that the display device also has other essential components, which are not described herein nor should they be construed as limiting the present disclosure.

It could be understood that the above embodiments are merely exemplary embodiments adopted for describing the principle of the present disclosure, but the present disclosure is not limited thereto. Various variations and improvements may be made by those of ordinary skill in the art without departing from the spirit and essence of the present disclosure, and these variations and improvements shall also be regarded as falling into the protection scope of the present disclosure.

What is claimed is:

1. An antenna, comprising:

a first substrate;

a base material layer on the first substrate and having a plurality of antenna cavities arranged in an array therein; and a conductive layer on a sidewall of each of the plurality of antenna cavities, each of the plurality of antenna cavities and the conductive layer on the sidewall thereof forming an antenna unit, wherein each of the plurality of antenna cavities comprises a first opening, and an aperture of the first opening at a position of the antenna cavity close to the first substrate is smaller than an aperture of the first opening at a position of the antenna cavity away from the first substrate, wherein each of the plurality of antenna cavities comprises a first cavity and a second cavity in physical contact with the first cavity, the second cavity being closer to the first substrate than the first cavity;

the first cavity comprises a second opening, and the second cavity comprises a third opening;

in a direction pointing from the second cavity to the first cavity, an aperture of the second opening gradually increases, and an aperture of the third opening is constant; and a difference between the aperture of the second opening at a position of the first cavity in physical contact with the second cavity and the aperture of the third opening is smaller than a first value.

2. The antenna of claim 1, wherein the first value is 1 μm.

3. The antenna of claim 2, wherein the aperture of the second opening at the position of the first cavity in physical contact with the second cavity is equal to the aperture of the third opening.

4. The antenna of claim 1, wherein the first cavity comprises at least one first sidewall inclined relative to the first substrate; and the second cavity comprises at least one second sidewall perpendicular to the first substrate.

5. The antenna of claim 4, wherein the first cavity has a hollow portion of a truncated pyramid shape and comprises four first sidewalls inclined relative to the first substrate; and the second cavity has a hollow portion of a cuboid shape and comprises four second sidewalls perpendicular to the first substrate.

6. The antenna of claim 4, wherein the first cavity has a hollow portion of a circular truncated cone shape and comprises an arc-shaped first sidewall inclined relative to the first substrate; and the second cavity has a hollow portion of a cylinder shape and comprises an arc-shaped second sidewall perpendicular to the first substrate.

7. The antenna of claim 1, wherein a material of the base material layer comprises any one of silicon, quartz, and ceramic.

8. An antenna device, comprising the antenna of claim 1 and a phase shifter connected to the antenna.

9. The antenna device of claim 8, wherein the phase shifter comprises second and third substrates opposite to each other, and a dielectric layer between the second and third substrates, and the second and third substrates are configured to generate an electric field therebetween to change a dielectric constant of the dielectric layer.

10. The antenna device of claim 9, wherein the first substrate serves as the second substrate.

11. The antenna device of claim 9, wherein a first electrode layer is on a side of the second substrate close to the third substrate, and a second electrode layer is on a side of the third substrate close to the second substrate;

the first electrode layer has a plurality of slits, the plurality of slits are in one-to-one correspondence with the plurality of antenna cavities, and an orthographic projection of the first opening of each of the plurality of antenna cavities on the third substrate at least partially overlaps with an orthographic projection of the slit corresponding to the first opening on the third substrate; and the second electrode layer comprises a plurality of sub-electrodes, the plurality of sub-electrodes are in one-to-one correspondence with the plurality of antenna cavities, and the orthographic projection of the first opening of each of the plurality of antenna cavities on the third substrate at least partially overlaps with an orthographic projection of the sub-electrode corresponding to the first opening on the third substrate.

12. The antenna device of claim 11, wherein each of the plurality of sub-electrodes has a shape of at least one of a comb shape and a spiral shape when viewed in a plan view.

13. A method for fabricating an antenna, comprising:

preparing a first substrate;

forming a base material layer on the first substrate;

forming a plurality of antenna cavities arranged in an array in the base material layer; and forming a conductive layer on a sidewall of each of the plurality of antenna cavities, wherein each of the plurality of antenna cavities comprises a first opening, and an aperture of the first opening at a position of the antenna cavity close to the first substrate is smaller than an aperture of the first opening at a position of the antenna cavity away from the first substrate, wherein each of the plurality of antenna cavities comprises a first cavity and a second cavity in physical contact with the first cavity, the second cavity being closer to the first substrate than the first cavity;

the first cavity comprises a second opening, and the second cavity comprises a third opening;

in a direction pointing from the second cavity to the first cavity, an aperture of the second opening gradually increases, and an aperture of the third opening is constant; and a difference between the aperture of the second opening at a position of the first cavity in physical contact with the second cavity and the aperture of the third opening is smaller than a first value.

14. The method of claim 13, wherein a material of the base material layer is silicon; and forming the plurality of antenna cavities arranged in an array in the base material layer comprises:

forming the plurality of antenna cavities arranged in an array by a bulk silicon etching process.

15. A method for fabricating an antenna device, comprising:

fabricating an antenna, wherein the antenna is the antenna of claim 1;

fabricating a phase shifter; and assembling the antenna and the phase shifter into a single body by a bonding process or a laminating process.

16. The method of claim 15, wherein the phase shifter comprises second and third substrates opposite to each other, and a dielectric layer between the second and third substrates, and the second and third substrates are configured to generate an electric field therebetween to change a dielectric constant of the dielectric layer.

17. The method of claim 16, wherein the first substrate serves as the second substrate.

18. The method of claim 17, wherein a first electrode layer is on a side of the second substrate close to the third substrate, and a second electrode layer is on a side of the third substrate close to the second substrate;

the first electrode layer has a plurality of slits, the plurality of slits are in one-to-one correspondence with the plurality of antenna cavities, and an orthographic projection of the first opening of each of the plurality of antenna cavities on the third substrate at least partially overlaps with an orthographic projection of the slit corresponding to the first opening on the third substrate; and the second electrode layer comprises a plurality of sub-electrodes, the plurality of sub-electrodes are in one-to-one correspondence with the plurality of antenna cavities, and the orthographic projection of the first opening of each of the plurality of antenna cavities on the third substrate at least partially overlaps with an orthographic projection of the sub-electrode corresponding to the first opening on the third substrate.

19. The method of claim 18, wherein each of the plurality of sub-electrodes has a shape of at least one of a comb shape and a spiral shape when viewed in a plan view.

* * * * *